United States Patent [19]

Meyer

[11] 4,388,681

[45] Jun. 14, 1983

[54] HAZARDOUS LOCATION LIGHT FIXTURE

[75] Inventor: E. Robert Meyer, Packanack Lake, N.J.

[73] Assignee: Keene Corporation, Union, N.J.

[21] Appl. No.: 216,564

[22] Filed: Dec. 15, 1980

[51] Int. Cl.[3] ..... F21V 17/00

[52] U.S. Cl. ..... 362/374; 362/375; 362/267

[58] Field of Search ..... 362/267, 375, 374

[56] References Cited

U.S. PATENT DOCUMENTS 2,777,942 1/1957 Lester ..... 362/267

*Primary Examiner*—Stephen J. Lechert, Jr.

*Attorney, Agent, or Firm*—Kane, Dalsimer, Kane, Sullivan and Kurucz

[57] ABSTRACT

An explosion-resistant fixture is provided comprising a ballast compartment and lamp compartment. The ballast compartment contains the usual electrical components for the fixture and all voids within the compartment are filled with a non-flammable material thereby preventing explosive gases or volatile liquids from entering the compartment. The filling material is preferably an expanded closed cell foam material.

4 Claims, 3 Drawing Figures

FIG. 1
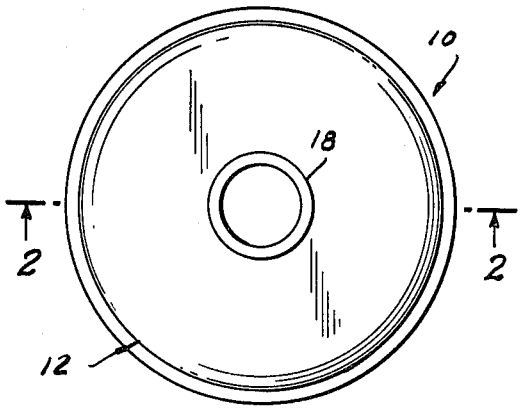
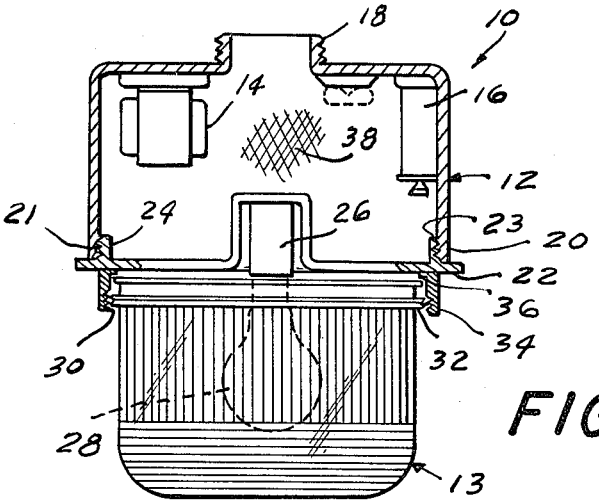
FIG. 2
FIG. 3
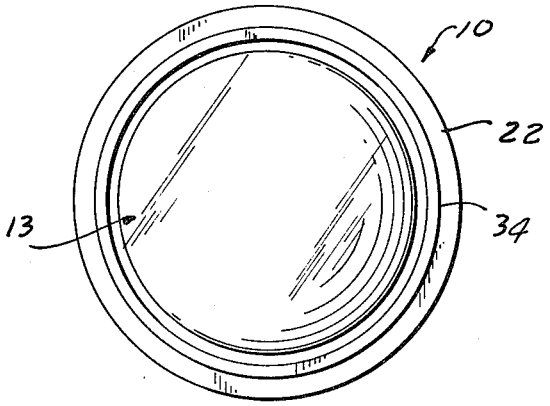

HAZARDOUS LOCATION LIGHT FIXTURE

The present invention relates to lighting fixtures and in particular to a lighting fixture designed for hazardous locations.

In order to provide lighting for hazardous locations (i.e., where flammable gases or volatile liquids are present) it has heretofore been necessary to provide special heavy-walled fixtures. The fixtures are necessarily heavy-walled since the casing must be capable of withstanding an explosion of a gas or vapor which may occur within it as a result of a spark from the fixture igniting material entrapped within the casing. Ignition may also occur as a result of a temperature rise within the fixture resulting from a faulty component such as a transformer or ballast. The objection of such prior art fixtures has been to contain the explosion within the fixture and to the limited quantity of material entrapped within the fixture to thereby prevent ignition of the flammable material within the surrounding environment.

The heavy-walled fixtures of the prior art also were necessary to enable accurate threads to be machined on mating portions of the casing wall and lens to minimize the leakage of flammable material into the fixture interior and also to lengthen the flame path in the event of ignition. The latter serves to maximize the prospects of a flame from within the fixture being naturally extinguished before reaching the outside. A typical explosion-proof fixture of the prior art is disclosed in U.S. Pat. No. 2,702,849.

Heavy-walled fixtures are undesirable for several reasons. In the first place, the additional material necessary to produce the heavy wall adds to the cost of the fixture and to its overall manufacture. Further, the increased weight of the fixture poses problems in connection with its mounting and installation.

In view of the above, it is the principal object of the present invention to provide an explosion-resistant fixture the walls of which are no thicker than those for a conventional fixture.

A further object is to provide an explosion-resistant fixture the overall configuration of which may be substantially the same as for a conventional fixture and which hence requires no special mounting or support means.

Still further objects and advantages of the present invention will become apparent from the following description of the invention.

SUMMARY OF THE INVENTION

The above and other beneficial objects and advantages are attained in accordance with the present invention by providing an explosion-resistant fixture comprising a ballast compartment and lamp compartment. The ballast compartment contains the usual electrical components for an industrial light fixture such as the ballast, capacitor, transformer, etc. as well as the input electrical terminal. The electrical interconnections for the fixtures are contained within the ballast compartment and made in the usual manner. A lamp socket extends from the ballast compartment and is suitably connected with the electrical components in a conventional manner. A sealing plate seals the ballast compartment surrounding the socket. A lamp housing including a reflector and the like is sealed to the plate surrounding the socket and any lamp mounted within the socket. In accordance with the present invention, all voids within the ballast compartment are filled with a non-flammable material thereby preventing any volatile gas or liquid from entering the fixture. While virtually any non-flammable material may be used, a closed cell foamed material is preferable since it permits filling the fixture interior fully with a minimum of added weight.

In operation, the filling material serves to prevent any gases or volatile liquid from entering the ballast compartment since the entire volume of the ballast compartment is filled. In this manner, explosions which the prior art sought to contain are prevented from occurring.

The lamp housing is sealed to the ballast compartment in a more or less conventional manner so that the fixture, in effect, is made impervious to the hazardous gases of its

BRIEF DESCRIPTION OF THE DRAWINGS

In the accompanying drawings:

FIG. 1 is a top-plan view of an explosion-resistant fixture in accordance with the present invention;

FIG. 2 is a side-elevational sectional view of the fixture; and

FIG. 3 is a bottom-plan view of the fixture. DETAILED DESCRIPTION OF THE PREFERRED EMBODIMENT Reference is now made to the drawings wherein an explosion-resistant fixture 10 in accordance with the present invention is depicted. The fixture comprises essentially a ballast housing 12 and lamp housing 13. The ballast housing 12 may be formed in a conventional manner and of conventional material. Thus, for instance, the fixture may be stamped, spun or cast of aluminum, sheet metal, plastic, or any other appropriate material. The walls of the fixture need not be any thicker than those required for conventional non-hazardous environments and hence need only be sufficiently thick to retain their shape and support the components contained herein. It is important to note that no special reinforcing is required as was the case with prior art hazardous location fixtures. Contained within the ballast compartment are the usual transformer 14, capacitor 16, starter, if necessary, etc. A threaded opening 18 in the top of the fixture provides access to the interior of the compartment for electrical cable and conduit.

The bottom end 20 of ballast compartment 12 contains internal threads 21 extending toward the top of the fixture. A closing plate 22 having a threaded neck portion 24 serves to seal the open bottom end of the ballast compartment with the threads 23 on neck 24 engaging the threads 21 at the bottom end 20 of the ballast compartment. The plate 22 serves to close off the ballast compartment but need not provide an exceptionally tight seal. A socket 26 is mounted to plate 22 extending away from the ballast compartment. Suitable electrical connections (not shown) for the socket extend from the electrical components within the ballast to the socket through openings in the top side of the plate.

Socket 26 may be a conventional porcelain lamp socket designed to accept a high intensity, fluorescent or other appropriate light bulb. As shown, the bulb 28 extends away from the ballast compartment. The lamp housing 13 is formed of glass or an appropriate transparent plastic material and surrounds the lamp in the usual manner. If desired, reflectors or lenses may be molded into the lamp housing in the usual manner. The top end 30 of housing 13 defines a rim which captures a threaded ring 32 surrounding the top of the lamp housing. An internally threaded neck 34 extends downwardly from plate 22 and a corresponding thread is provided on the outside of ring 32. By turning down on ring 32, the housing lip 30 can be forced to seat against a shoulder 36 on neck 34 thereby sealing the lamp housing to the plate.

In accordance with the present invention, the ballast compartment 12 is filled with a non-flammable filler material 38. That is, all voids within the ballast compartment not occupied by the electrical components are filled with the filler material. To this end the seal between plate 22 and the ballast housing should be sufficient to contain the filler material in position. As a result little or none of the volatile gases can come into contact with the electrical components. Thus, rather than seeking to contain any explosion within the ballast compartment the present invention seeks to minimize or avoid such explosion.

While virtually any filler material may be utilized, certain obvious parameters should be met. The filler material preferably should occupy the greatest volume with a minimum of weight. Further, the filler material should be compatible with the gas or volatile material of the hazardous location and not be subject to decomposition in the presence of the material. In addition, the filler material should be compatible with the electrical components and connections contained within the ballast compartment.

In a successful practice of the invention, an expanded polyurethane closed cell foam material was utilized as a filler material. The foam is sold under the same Stepanfoam G-302 and is commercially available from the Stepan Chemical Company of Northfield, Ill. The precise material chosen for any particular application will, obviously, be determined to some extent by the nature of the gases or volatile liquids contained within the environment.

By filling the ballast compartment with foam material, little or no accumulation of flammable material can occur within the ballast compartment and hence no explosion can occur. As a result, the need for the reinforced walls of the prior art explosion-resistant fixture within which an explosion could occur is eliminated. Thus, in accordance with the above, the aforementioned objects are effectively attained.

Having thus described the invention, what is claimed is:

1. An explosion-resistant fixture comprising: a ballast compartment containing therein the electrical components for the fixture; a lamp housing containing a lamp socket mounted to said ballast compartment; and filling means filling all voids in said ballast compartment.

2. The fixture in accordance with claim 1 further comprising closure means closing said ballast compartment and containing said filling means therein.

3. The fixture in accordance with claim 1 wherein said filling means comprises an expanded closed cell foam material.

4. The fixture in accordance with claims 1, 2 or 3 wherein said ballast compartment includes an open-bottomed end, a plate carrying said lamp socket closing said bottom end, said plate having first means for sealingly engaging said ballast compartment and second means for sealingly engaging said lamp housing.

* * * * *